US005941718A

United States Patent [19]

Didier

[11] Patent Number: 5,941,718

[45] Date of Patent: Aug. 24, 1999

[54] AIRCRAFT GROUND POWER CABLE CONNECTOR

[76] Inventor: Robert G. Didier, 639 Green View Dr., Santa Rosa, Calif. 95403

[21] Appl. No.: 08/948,391

[22] Filed: Oct. 10, 1997

Related U.S. Application Data

[63] Continuation of application No. 08/755,709, Nov. 25, 1996, abandoned, which is a continuation of application No. 08/445,736, May 22, 1995, abandoned.

[51] Int. Cl.[6] ..... H01R 29/00

[52] U.S. Cl. ..... 439/170; 439/606; 439/686

[58] Field of Search ..... 439/170, 171, 439/172, 175, 166, 606, 620, 686, 690, 695, 891, 274, 464

[56] References Cited

U.S. PATENT DOCUMENTS

| | | | |
|---|---|---|---|
| 1,574,064 | 2/1926 | Chamberlain | 439/170 |
| 1,870,762 | 8/1932 | Winter | 439/170 X |
| 3,382,475 | 5/1968 | Kramer | 439/170 X |
| 3,605,059 | 9/1971 | Lipinski | 439/690 |
| 3,699,499 | 10/1972 | Spaderna | 439/690 |
| 4,170,393 | 10/1979 | Mocek, Jr. et al. | 439/891 |
| 4,193,655 | 3/1980 | Herrmann, Jr. | 439/166 |
| 4,199,207 | 4/1980 | Lee | 439/690 |
| 4,368,940 | 1/1983 | Sugiura | 439/170 |
| 4,717,350 | 1/1988 | Lax | 439/620 X |
| 4,758,175 | 7/1988 | Didier et al. | 439/281 |
| 5,256,081 | 10/1993 | Didier | 439/464 |
| 5,413,506 | 5/1995 | Thompson | 439/695 |
| 5,595,497 | 1/1997 | Wood | 439/606 |

FOREIGN PATENT DOCUMENTS

| | | | |
|---|---|---|---|
| 3511194 | 4/1986 | Germany | 439/170 |
| 4301503 | 10/1993 | Germany | 439/686 |
| 901212 | 7/1962 | United Kingdom | 439/170 |

*Primary Examiner*—Neil Abrams
*Assistant Examiner*—Brian J. Biggi
*Attorney, Agent, or Firm*—Dergosits & Noah LLP

[57] ABSTRACT

A ground power connector has a removable contact insulation cover and replaceable individual contact components. The connector body is integrally molded at one end to a ground power cable. The other end of the connector body is provided with integral fixed contacts to which a removable contact insulation cover section may be threadably secured. Replaceable contact components are threadably secured to the fixed contacts and covered by the insulation cover. A replaceable sealed switch assembly may also be incorporated.

9 Claims, 2 Drawing Sheets

AIRCRAFT GROUND POWER CABLE CONNECTOR

This is a continuation of application Ser. No. 08/755,709, filed on Nov. 25, 1996, now abandoned, which is a continuation of application Ser. No. 08/445,736, filed on May 22, 1995, also abandoned.

BACKGROUND OF THE INVENTION

This invention relates in general to aircraft ground power connector systems for providing electrical power to aircraft when they are on the ground with engines and auxiliary power units turned off. In particular, the invention concerns connectors attached to power cables and having replaceable elements.

Most aircraft are equipped with power connectors, such as a male plug receptacle recessed into a cavity of the aircraft for protection. A mating female connector having a power cable attached thereto is plugged into the male connector when power is needed on board the aircraft. However, the female connector is subjected to considerable abuse from abrasion due to falls against the concrete or asphalt surfaces on which the aircraft is located as well as degradation due to exposure to weather and petroleum products.

Very early ground power cable and connector systems included a number of single conductors banded together at intervals and connected to the contacts in the connector. Because the bands were metallic, abrasion against concrete or asphalt surfaces would make the bands razor sharp and therefore a significant cut hazard.

These early connectors lacked any switching capability. Further, the contact members of such connectors would lose their gripping force with use, and the weight of the connector combined with the weight of the cable would cause the connector to drop out of the aircraft receptacle and fall to the ground.

To overcome these early cable and connector shortcomings, switches have been provided within the connector body so that the power could be turned on and off at the aircraft without walking back and forth to some remote switching location. See, for example, my prior U.S. Pat. No. 4,758,175, which is expressly incorporated herein by reference. Also, control conductors were included in the power cable to provide remote power switching capability in a single sheath, thereby providing protection for the small control conductors, which also eliminated the need for banding the conductors and the problems associated with the metal bands. The small control conductors are connected to switches in the connector body. The power conductors are attached to contacts in the connector head. However, to overcome the loss of the contact gripping power which resulted in the connector falling out of the aircraft receptacle, the newer connector designs add a replaceable nose section complete with additional contacts integrally molded therein and which plug into the contacts which are molded into the connector body. See, for example, my prior U.S. Pat. No. 5,256,081, which is expressly incorporated by reference herein. However, the added nose section increases the overall connector length and weight with the result of diminishing the gripping forces on the aircraft receptacle contacts, thereby making the connector more susceptible to dropping out of the aircraft receptacle. Further, the replaceable nose section adds an additional set of contacts in the connector, which doubles the electrical power loss due to the electrical resistance of engaged contacts which results in increased heating of the connector.

SUMMARY OF THE INVENTION

An object of the present invention is the improvement of aircraft power connector and cable systems.

A further object of the invention is an aircraft power connector that uses only one set of contacts, thereby reducing power loss and weight.

Another object of this invention is an aircraft power connector in which the most vulnerable components can be individually replaceable in the field.

These and other features and advantages are achieved in the present invention by constructing a one piece connector body having replaceable outer components that are subject to wear and degradation from use in the field. The rear section of the connector body is integrally molded or attached to the cable jacket or banded power conductors. The contact section includes a rear portion which is integrally molded to the contacts over a portion of their length and to the connector body. The front insulation cover surrounds a portion of the contacts and is attached by screws to the connector body. The front insulation cover can be removed, exposing the front portion of the contact section. A portion of each contact section is threaded and, therefore, may be individually removed and replaced.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 5A:
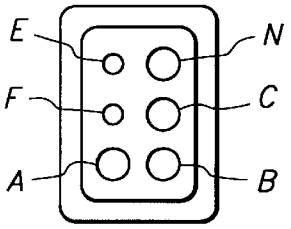
FIG. 5A is a front plan view of an aircraft connector that mates with the connector of the present invention.
Figure 5B:
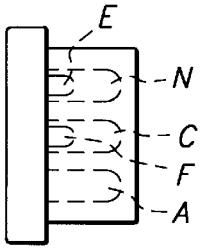
FIG. 5B is a side plan view of the aircraft connector shown in FIG. 5A.

FIG. 5 shows a face view of a typical six contact, three-phase, alternating current plug connector of the type used for jet aircraft. Four power contacts are provided and are labeled A, B, C and N. Two relays contacts are provided and are labeled E and F. It should be obvious to one with ordinary skill in the art that many connector variations exist wherein the construction is essentially the same as shown and described below except for the number of contacts.

Figure 1:
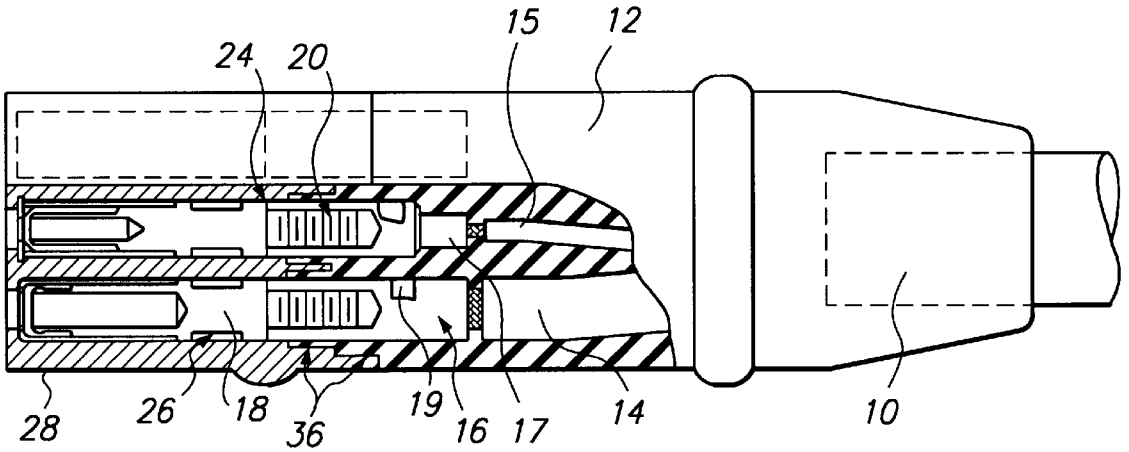
FIG. 1 is a side plan view of a connector and power cable according to the present invention, including a sectional view through section 1—1 of FIG. 5.

Referring now to FIG. 1, a power cable 10 has a connector body 12 integrally molded thereto using a conventional molding process, such as rubber molding or similar. The power cable 10 may include a plurality of conductors, such as power conductor 14 and relay control signal conductor 15. The power conductor 14 corresponds to contact A in FIG. 5, and the control conductor 15 corresponds to contact F in FIG. 5. The conductor 14 is connected to the rear portion 16 of a pin receptor corresponding to contact A, for example, by solder or crimp. Likewise, the conductor 15 is connected to the rear portion 17 of a pin receptor corresponding to contact F.

In the preferred embodiment, the rear portion 16 and the front portion 18 are removably coupled to each other by suitable mechanical means. For example, the rear portion 16 of the pin receptor corresponding to contact A is provided with internal threads. The front portion 18 of the pin receptor corresponding to contact A includes a threaded stud that screws into the internal threads of the rear portion 16. However, in an alternative embodiment, the front and rear portions are not discrete components, but instead, the pin receptor is a unitary structure affixed within the connector body and extending from one side thereof.

The rear portion 16 is also provided with a slotted section 19, or some other mechanical means such as a raised knurl, to prevent the rear portion 16 from twisting or pulling out from the connector body 12 due to applied torque from removing or attaching a new front contact portion 18.

The front portion 18 also has a pair of flat regions 26 whereby a wrench (not shown) may be used to tighten or loosen this screw connection. The rear portion 16 also has a shoulder region 24 which abuts the front portion 18 when the two portions are screwed together. Therefore, electrical connection between the front and rear portions is provided both by the thread connection and by contact at the shoulder region. A conductive wire coil spring or similar device (not shown) could be added within the cavity formed between rear portion 16 and front portion 18 to further increase conductivity.

Figure 2:
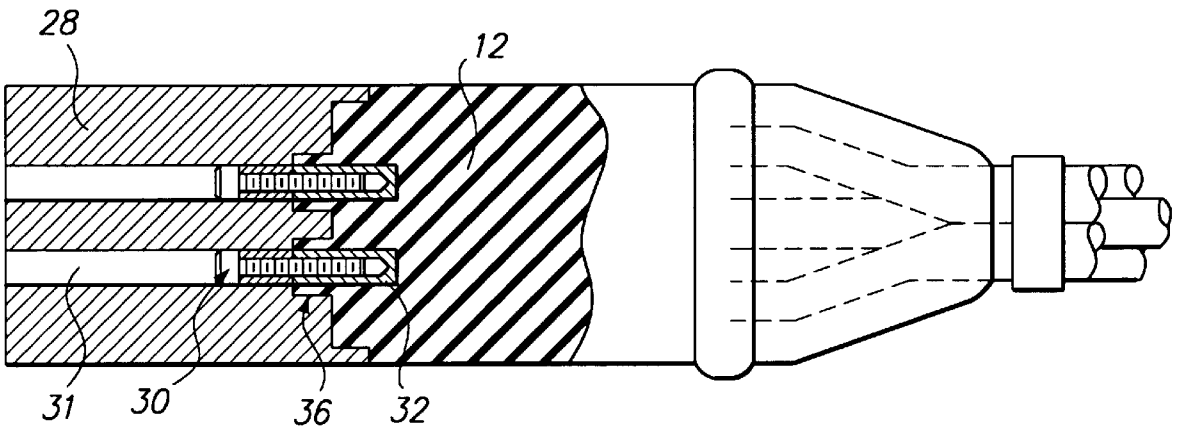
FIG. 2 is a side plan view of the connector and power cable of FIG. 1, including a sectional view through section 2—2 of FIG. 5.

A contact insulation cover 28 fits over the pin receptors, as better illustrated in FIG. 2. The contact insulation cover 28 includes throughholes to freely accommodate each of the pin receptors. The contact insulation cover 28 is removably attached to the molded connector body 12, for example, by two screws 30 through openings 31 in the cover 28 into threaded portions 32 of the connector body. While these two screw connections are shown as being centrally located relative to the contacts, other connection positions are of course possible.

The molded body 12 includes raised lips 36 in all places where connection with cover 28 occurs, i.e., where the attachment screws 30 connect to the molded body 12, where the rear portion 16 connects to the front portion 18 for each pin receptor, and where the periphery of contact insulation cover 28 fits against the molded body 12. The raised lips 36 provide watertight sealing of each connection.

The molded body 12 is preferably made from flexible rubber or similar material to provide strain relief for the cable and to provide low temperature flexibility in cold weather climates. The front cover 28 is preferably made from a more rigid abrasion resistant plastic or rubber insulating material to provide greater protection for the contacts. Further, the front cover 28 can be color coded to distinguish it from the body 12 and to show more clearly the extent of wear.

Figure 3:
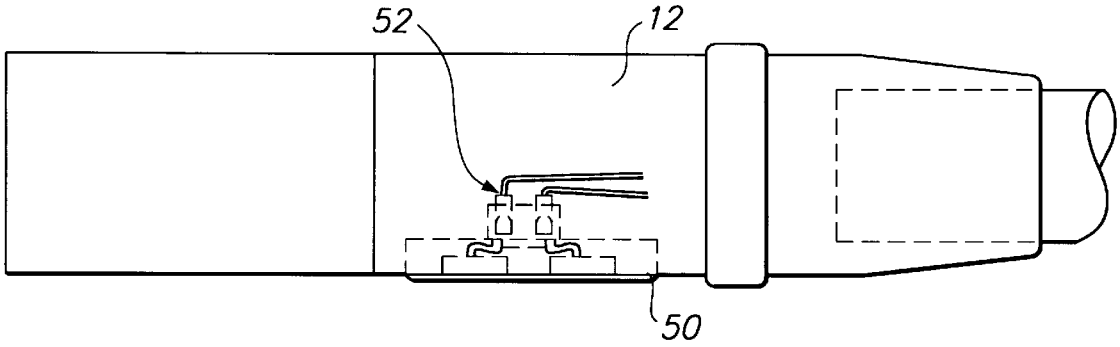
FIG. 3 is a side plan view of a connector and power cable having a weatherproof switch assembly.
Figure 4:
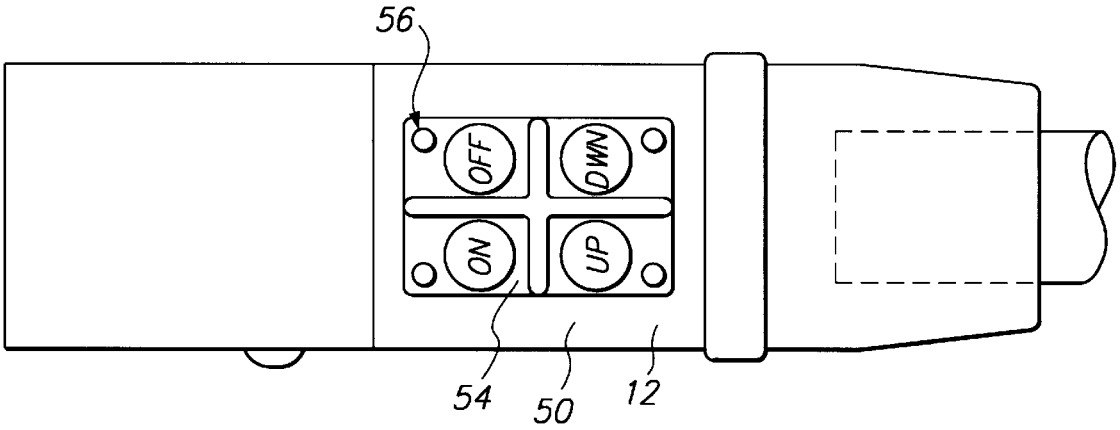
FIG. 4 is a top plan view of the connector and power cable of FIG. 3.

FIGS. 3 and 4 show a weatherproof switch assembly 50 incorporated within the molded body 12. The switch contacts 52 within the switch assembly 50 are connected to small control conductors in the power cable 10 and can operate switches at the power source or at remote locations. The cover plate 54 may be removably secured to the connector body 12 via screws 56. Thus, the switch or its components may also be individually replaced as required.

In practice, a pin gauge tester is used to test the contact force of each contact to check whether the connector meets minumum force requirements to hold it in the aircraft male plug receptacle. Where a single contact is damaged or fails to meet a minimum force requirement, the prior art requires that the complete connector or nose section be replaced. However, by utilizing the present invention, individual contacts or insulation covers may be replaced separately, thereby providing substantial savings in time and cost. The removable contact portions are optional and a connector with a removable front cover may be all that is needed.

It should be understood that the invention is not intended to be limited by the specifics of the above-described embodiment, but rather defined by the accompanying claims.

I claim:

1. A ground cable connector system utilizable for detachably connecting an aircraft having input power terminals to a power source, comprising:

a one piece connector body integrally molded of insulating material in weather-tight relationship to a sheath, said sheath enclosing at least one electrical conductor connected to at least one electrical contact, wherein the contact is rigidly affixed within the molded connector body and has an extended portion extending from one side of the molded connector body, a one piece connector cover molded of insulating material and having at least one throughhole for accommodating the contact, and means for removably coupling the connector cover to the one side of the connector body such that the throughhole accomodates the contact.

2. A ground cable connector system as in claim 1, wherein the sheath includes a plurality of electrical conductors connected to respective electrical contacts, wherein each contact is rigidly affixed within the molded connector body and has an extended portion extending from one side of the molded connector body, and wherein the connector cover includes a plurality of throughholes for accommodating the contacts and which is removable from the one side of the connector body over the extended portion of the contacts.

3. A ground cable connector system as in claim 1, wherein the contact includes a front portion extending from one side of the connector body and a rear portion rigidly affixed within the molded connector body, and wherein the front portion is removably coupled to the rear portion.

4. A ground cable connector system as in claim 1, wherein the contact includes a rear portion and a front portion, wherein the rear portion is rigidly affixed within the connector body and includes a threaded opening on the one side of the connector body, and wherein the front portion includes a threaded stud extending therefrom for mating engagement with the threaded opening.

5. A ground cable connector system as in claim 1, wherein the contact includes a rear portion and a front portion, wherein the rear portion is rigidly affixed within the connector body and includes a threaded stud extending from the one side of the connector body, and wherein the front portion includes a threaded opening for mating engagement with the threaded stud.

6. A ground cable connector system utilizable for detachably connecting an aircraft having a plurality of input power terminals to a power source, comprising:

a one-piece connector body integrally molded of insulating material in weather-tight relationship to a sheath, said sheath enclosing a plurality of electrical conductors each connected to a respective electrical contact, wherein each of said contacts is rigidly affixed within the molded connector body and arranged for mating engagement with the aircraft power terminals, wherein each of said contacts has a front portion and a rear portion adapted for removable coupling with each other and forming a single, unitary contact when coupled, wherein the rear portion is rigidly affixed within the connector body and wherein the front portion extends from one side of the connector body, and a one piece connector cover molded of insulating material and having throughholes which accommodate each contact, and means for removably coupling the connector cover to the one side of the connector body such that the throughholes accomodate the contacts.

7. A ground cable connector system as in claim 6, wherein the rear portion includes a threaded opening on the one side of the connector body, and wherein the front portion includes a threaded stud extending for mating engagement with the threaded opening.

8. A ground cable connector system as in claim 6, wherein the rear portion is affixed within the connector body and includes a threaded stud extending from the one side of the connector body, and wherein the front portion includes a threaded opening for mating engagement with the threaded stud.

9. A ground cable connector system utilizable for detachably connecting an aircraft having input power terminals to a power source, comprising:

a one-piece connector body integrally molded in a weather-tight relationship to a sheath, said sheath enclosing a plurality of electrical conductors connected to respective electrical contacts, wherein each of said contacts has a rear portion thereof rigidly affixed within the connector body and a front portion thereof extending from one side of the connector body, said front and rear portions including respective mechanical means for removable coupling with each other, and a one piece connector cover molded of insulating material and having throughholes which accommodate each contact, and means for removably coupling the connector cover to the one side of the connector body such that the throughholes accomodate the contacts.

* * * * *